US006250408B1

(12) United States Patent
Trujillo et al.

(10) Patent No.: US 6,250,408 B1
(45) Date of Patent: Jun. 26, 2001

(54) EARTH-BORING DRILL BITS WITH ENHANCED FORMATION CUTTINGS REMOVAL FEATURES

(75) Inventors: William R. Trujillo, South Salt Lake; Craig H. Cooley, So. Ogden, both of UT (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/490,378

(22) Filed: Jan. 24, 2000

Related U.S. Application Data

(62) Division of application No. 08/934,031, filed on Sep. 19, 1997, now Pat. No. 6,125,947.

(51) Int. Cl.[7] ..... E21B 10/60
(52) U.S. Cl. ..... 175/393
(58) Field of Search ..... 175/393, 340

(56) References Cited

U.S. PATENT DOCUMENTS

| | | | | |
|---|---|---|---|---|
| 3,112,803 | * | 12/1963 | Rowley | 175/393 |
| 4,098,363 | | 7/1978 | Rohde et al. . | |
| 4,246,977 | | 1/1981 | Allen | 175/393 X |
| 4,676,324 | * | 6/1987 | Barr et al. | 175/393 |
| 4,696,354 | | 9/1987 | King et al. . | |
| 4,733,734 | * | 3/1988 | Bardin et al. | 175/65 |
| 4,848,489 | | 7/1989 | Deane . | |
| 4,856,601 | * | 8/1989 | Raney | 175/393 |
| 5,099,929 | | 3/1992 | Keith et al. . | |
| 5,186,268 | | 2/1993 | Clegg . | |
| 5,197,554 | | 3/1993 | Zijsling . | |
| 5,222,566 | | 6/1993 | Taylor et al. . | |
| 5,244,039 | | 9/1993 | Newton, Jr. et al. . | |
| 5,363,932 | | 11/1994 | Azar . | |
| 5,417,296 | | 5/1995 | Murdock . | |
| 5,443,565 | | 8/1995 | Strange, Jr. . | |
| 5,549,171 | | 8/1996 | Mensa-Wilmot et al. . | |
| 5,651,421 | | 7/1997 | Newton et al. . | |
| 5,699,868 | | 12/1997 | Caraway et al. | 175/339 |
| 5,794,725 | | 8/1998 | Trujillo et al. . | |
| 5,816,346 | * | 10/1998 | Beaton | 175/431 |
| 5,819,860 | | 10/1998 | Newton et al. . | |
| 5,937,958 | | 8/1999 | Mensa-Wilmot et al. | 175/398 |
| 6,006,845 | * | 12/1999 | Illerhaus et al. | 175/406 |
| 6,021,858 | | 2/2000 | Southland | 175/431 |
| 6,062,325 | * | 5/2000 | Taylor et al. | 175/393 |
| 6,089,336 | * | 7/2000 | Nexton et al. | 175/393 |

FOREIGN PATENT DOCUMENTS

| | | |
|---|---|---|
| 0 742 342 A2 | 4/1996 | (EP) . |
| 2 325 014 | 4/1998 | (GB) . |

OTHER PUBLICATIONS

Taylor, M.R., et al., *High Penetration Rates and Extended Bit Life Through Revolutionary Hydraulic and Mechanical Design in PDC Drill Bit Development,* SPE 36435, Society of Petroleum Engineers, Inc., 1996, pp. 191–204.
Search Report under Section 17, dated Nov. 18, 1998.

* cited by examiner

*Primary Examiner*—Hoang Dang
(74) *Attorney, Agent, or Firm*—TraskBritt

(57) ABSTRACT

Rotary drag bits with enhanced formation cuttings removal achieved by apportioning drilling fluid flow in relationship to cuttings volume generated by various groups of cutters on the bit, each cutter group being located on a different blade of the bit. The flow apportionment may be effected by selective placement of nozzles on the bit face, employing different sized nozzles, by varying the orientation of similarly-sized nozzles, or by a combination of approaches. In addition, the transverse cross-sectional areas of the junk slots associated with each of the various blades are sized in similar proportion to the formation cuttings volume removed by each of the cutter groups. Finally, cuttings volumes from each blade of a particular type or category, such as primary, secondary, tertiary, are substantially mutually balanced with the volumes of the other blades of the same type or category.

21 Claims, 5 Drawing Sheets

EARTH-BORING DRILL BITS WITH ENHANCED FORMATION CUTTINGS REMOVAL FEATURES

CROSS REFERENCE TO RELATED APPLICATION

This application is a divisional of application Ser. No. 08/934,031, filed Sep. 19, 1997, now U.S. Pat. No. 6,125,947.

BACKGROUND OF THE INVENTION

1. Field of the Invention

The present invention relates generally to bits for drilling subterranean formations. More specifically, the invention relates to multiple nozzle rotary drag bits employing variations in nozzle size and orientation to apportion hydraulic flow volume on the bit face in relationship to formation cuttings volume generated by groups of cutters on the bit, as well as to bits employing junk slots with cross-sectional areas apportioned in relationship to cuttings generated by groups of cutters with which the junk slots are respectively associated, such features providing enhanced formation cuttings clearance from the bit face, through the junk slots, and into the well bore annulus above the bit.

2. State of the Art

Design of rotary drag bits employing superabrasive cutters, usually in the form of so-called "polycrystalline diamond compacts", or "PDCs," has reached a high degree of sophistication over the last several decades. Marked increases in rate of penetration (ROP) have been achieved. However, the inability of state-of-the-art rotary drill bits to clear formation cuttings at a rate commensurate with the bits' ability to generate such cuttings has proven to be a troublesome limitation to further increases in ROP.

Various designs and approaches have been employed in the art to facilitate cuttings removal from the bit, and thus facilitate increases in ROP. However, such designs and approaches have generally involved features which are not readily employable in bits of a variety of sizes and configurations, and many are limited to very specific configurations. Moreover, the prior art approaches have failed to consider and appreciate the tendency of poor cuttings clearance from a single blade of a multi-bladed bit to hinder ROP.

One prior art approach to cuttings removal from the bit involving a specialized bit design is disclosed in U.S. Pat. No. 5,417,296, wherein nozzles for supplying drilling fluid are placed both near the center of the bit and near the gage. An outer nozzle associated with one blade and fluid course on the bit face is oriented so as to provide a significant fluid flow component directed inwardly toward the centerline of the bit to augment the outward flow from an inner nozzle associated with another blade and fluid course through communication between the adjacent inner ends of the two fluid courses. Such an arrangement, in theory, enhances formation cuttings clearance, but it has been reported that this is not the case in practice. Specifically, cuttings from the blade with which the outer nozzle is associated are carried inwardly to a constriction between blades, causing clogging of the fluid course fronting that blade and consequent balling of the bit.

Accordingly, the art is, to date, devoid of enhancements to rotary drag bit design in terms of formation cuttings clearance readily applicable to improve the performance in terms of ROP of otherwise conventional bits.

SUMMARY OF THE INVENTION

The present invention provides enhancements to formation cuttings clearance from rotary drag bits through design enhancements readily implementable in a wide variety of blade-type rotary drag bits.

In one aspect, the present invention provides enhanced formation cuttings clearance through optimized distribution of hydraulic energy in the form of drilling fluid flow apportionment in relationship to the total volume of cuttings generated by different groups of cutters, typically those cutters grouped on each blade of a multi-bladed bit. Such apportionment may be achieved by employing nozzles of differing aperture sizes, and thus relative flow volumes, in association with blades generating differing formation cuttings volumes. For example, in a four-bladed bit with two primary blades and two secondary blades, the terms "primary" and "secondary" being indicative of their relative roles in volume of cuttings removed from the formation, the primary blades may each remove twice the cuttings volume as each of the secondary blades. Accordingly, in a one nozzle per blade bit, the nozzles associated with the primary blades are sized to provide substantially twice the fluid flow as those associated with the secondary blades.

In another aspect, the present invention provides optimized distribution of hydraulic energy through selective orientation, or "tilt", of nozzles on the bit face in terms of angles relative to a line taken perpendicular to a tangent to the bit profile at the point the fluid jet from a nozzle impinges upon the formation being drilled. If the fluid jet is coincident with the line, substantially equal volumes of drilling fluid will flow outwardly toward the gage and inwardly toward the centerline or longitudinal axis, in the area defined between the bit face and the formation. A positive tilt, wherein a nozzle is oriented to direct a fluid jet from a point of origin radially inboard of the line, results in a greater fluid flow outwardly through a fluid course toward the gage rather than inwardly toward the centerline, enhancing clearance of formation cuttings from the blade fronted by that fluid course. Conversely, a negative tilt, wherein a nozzle is oriented to direct a fluid jet from a point of origin radially outboard from the line, results in a greater fluid flow inwardly along a fluid course toward the centerline than outwardly toward the gage, resulting in difficulty in clearing formation cuttings from the bit face. As noted with respect to the aforementioned '296 patent, such inward flow will tend to clog the fluid courses rather than clear them. The present invention employs positive tilt of the various nozzles on a bit face to ensure predominant outward flow of drilling fluid toward junk slots of the bit located proximate the bit gage, and to minimize cross-flow on the bit face between fluid courses with which different nozzles are associated.

In a further aspect of the invention, it may be desirable or required, due to the configuration or size of the bit, that fewer nozzles are employed than blades. In such an arrangement, a single nozzle may provide drilling fluid to two fluid courses, for example, one lying in front of a primary blade and the other in front of a secondary blade. Therefore nozzle orientation, or the orientation of the nozzle aperture, may be employed to allocate or apportion fluid flow from a single nozzle between the primary and secondary fluid courses, especially when the nozzle is placed at or near a convergence point of the two fluid courses. It should be noted that nozzle orientation may be altered in any direction, and not merely in terms of "tilt" along a radial line from the centerline of the bit to the gage, in order to bias nozzle flow toward a fluid course. In other words, to allocate or split flow between two fluid courses with which the nozzle is associated, normally by placement adjacent the radially inner ends of both, the "side to side" orientation of the nozzle or its aperture may be altered.

In yet another aspect, the present invention provides enhanced formation cuttings clearance through sizing the cross-sectional areas of junk slots associated with various blades of a bit in similar proportion to the total formation cuttings volume generated by each of the blades. Again taking a four-bladed bit having two primary and two secondary blades by way of example, if the primary blades each generate twice the formation cuttings volume of each secondary blade, the junk slots are sized in a similar ratio in terms of cross-sectional area transverse to the bit centerline.

In still another aspect of the invention, at least two of the above-described features are employed in the same bit to facilitate formation cuttings removal from the bit face and through the junk slots, to the well bore annulus above the bit.

The present invention also contemplates substantially balancing the cuttings volume removed by each of the primary blades of a multi-bladed bit with the volume removed by the other or others, and the cuttings volume removed by each of the secondary blades with the volume removed by the other or others, so as to reduce the tendency of any particular blade to remove an excessive volume of cuttings, and thus exhibit a tendency to clog before the others, and inhibit ROP.

DETAILED DESCRIPTION OF THE INVENTION

Figure 1:
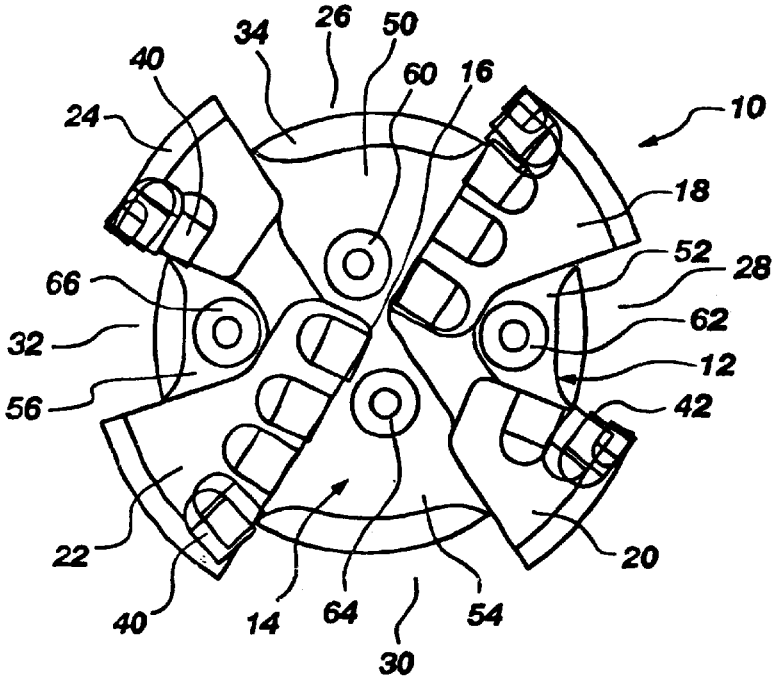
FIG. 1 is a view of a four-bladed drill bit according to the invention, looking upwardly at the bit face from the formation ahead of the bit.
Figure 1A:
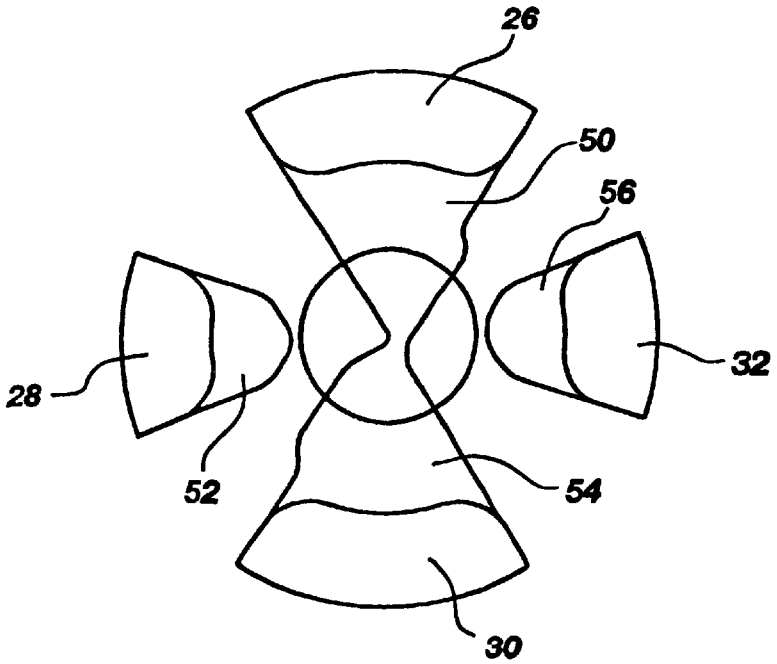
FIG. 1A is a schematic view of the bit face fluid course and associated junk slot pattern of the bit of FIG. 1, looking downwardly toward the formation being drilled and showing relative cross-sectional areas of the entrances to the junks slots transverse to the longitudinal axis of the bit.

Referring to FIGS. 1 and 1A of the drawings, a rotary drag bit 10 of the present invention is illustrated. Drag bit 10 includes a body 12 having a face 14 radially extending outward from the centerline or longitudinal axis 16 of the bit body 12. Four blades 18, 20, 22 and 24 extend over and above face 14 and radially outwardly therebeyond, defining four longitudinally extending junk slots 26, 28, 30 and 32 therebetween. An upper section 34 of the bit body 12 may be seen in FIG. 1 extending radially outwardly above and beyond the junk slots. A plurality or group of superabrasive cutters 40, preferably PDCs, is mounted to each blade 18 through 24 with their cutting faces 42 facing generally in the direction of bit rotation. Each group of cutters 40, respectively mounted to blades 18 through 24, generates cuttings of formation material into its associated fluid course 50, 52, 54 and 56 located rotationally in front of that cutter group as the bit 10 is rotated by a drill string and weight is applied to the bit 10 through the drill string. Fluid courses 50, 52, 54 and 56 respectively communicate with the entrances to junk slots 26, 28, 30 and 32 at laterally peripheral areas of bit body face 14. A plurality of nozzles 60, 62, 64 and 66 are shown on bit body face 14 adjacent the radially inner portions of fluid courses 50, 52, 54 and 56, the arrows in FIG. 1 showing the radial directions of the jets of drilling fluid discharged by each of the nozzles 60 through 66. The drilling fluid flow from the various nozzles 60 through 66 carries formation cuttings generated by each group of cutters 40 into fluid courses 50 through 56, to junk slots 26 through 32, and ultimately into the well bore annulus above bit 10 between the drill string and the well bore sidewall.

In accordance with one aspect of the present invention, the drilling fluid flow volume, and thus the hydraulic energy, through each of the fluid courses 50 through 56, is generally proportional to the relative volume of formation rock or "cuttings" cut by the groups of cutters 40 respectively mounted to each of blades 18 through 24 with which the fluid courses 50 through 56 are respectively associated. For example, if the cumulative volume of rock to be cut by the cutter groups of each of primary blades 18 and 22 is twice that cut by the cutter groups of each of secondary blades 20 and 24 (i.e., about 2:1), drilling fluid flow is adjusted by appropriately locating and orienting the nozzles 60 through 66 and varying the aperture sizes thereof accordingly to apportion the drilling fluid flowing to bit 10 through the drill string. While the proportioning of fluid flow into the various fluid courses need not exactly correspond to the relative volumes of cuttings from each blade with which the fluid courses are respectively associated, a variance of relative flow proportions within no more than about plus or minus twenty percent with respect to the rock volume proportions is desirable for optimum results. In its simplest implementation, nozzle aperture size may be varied to achieve the desired proportioning. For example, in the bit of FIG. 1, the nozzle aperture sizes associated with the primary blades may be 13/32 inch, and those associated with the secondary blades 9/32 inch, to provide the desired 2:1 flow volume proportioning.

In accordance with another aspect of the present invention, the entrances of junk slots 26 through 32 adjacent the lateral periphery of bit body face 14 are relatively sized, in terms of cross-sectional area transverse to the longitudinal axis 16, in similar proportion to the formation cuttings or rock volume cut by the cutter groups with which the junk slots are respectively associated. Again, using the previous example, if the rock volume cut by each of the primary blade 18, 22 cutter groups is twice the rock volume cut by each of the secondary blade 20, 24 cutter groups, the junk slot entrance areas of each of primary junk slots 26 and 30 will be generally twice the entrance areas of each of secondary junk slots 28 and 30. In bit 10 of FIG. 1, the actual primary to secondary blade rock volume proportions are about 1.8 to 1, while the relative primary to secondary junk slot entrance area proportions are about 1.7 to 1. Further, in bit 10 the fluid flow volume ratios between each of primary fluid courses 50, 54 and secondary fluid courses 52, 56 is about 2.1:1, although a flow volume proportion range of about 1.75 to 2.3:1 between primary and secondary fluid courses is contemplated as being suitable for the practice of the invention in bit 10.

Figure 3A:
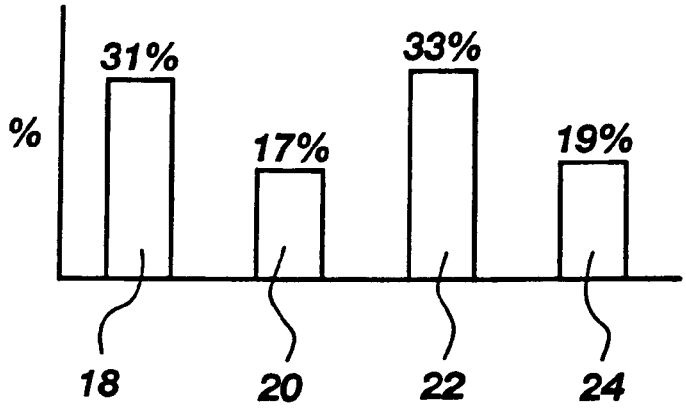
FIG. 3A is a bar graph showing relative formation cuttings volume generated by each blade of a cuttings volume-balanced four-bladed bit during a single revolution of the bit.
Figure 3B:
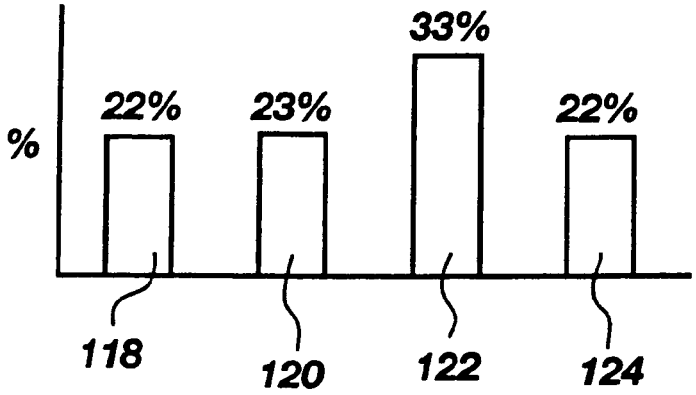
FIG. 3B is a bar graph showing relative formation cuttings volume generated by each blade of a cuttings volume-imbalanced four-bladed bit during a single revolution of the bit.

In accordance with yet another aspect of the invention, it will be understood by viewing FIGS. 1 and 1A that the rock volume cut by the cutter groups of each primary blade 18 and 22 will be substantially mutually balanced, and that the rock volume cut by the cutter groups of each secondary blade 20 and 24 will be substantially mutually balanced. In bits such as bit 310, discussed below with reference to FIGS. 5, 5A and 5B of the drawings, such substantial balancing is also extended to tertiary blades. Such balancing may be effected by employing the same number, size and exposure of cutters 40 on the blades to be balanced, although such balancing may be achieved even when employing a differing number of cutters by varying cutter size and, to some extent, exposure. It has been ascertained by the inventors that balancing rock volumes cut as described and proportioning associated drilling fluid flow volumes according to relative rock volumes (and thus balancing fluid flow volumes as well) will provide a noticeable increase in rate of penetration (ROP) for the bit before clogging or "balling", in comparison to a similar, but unbalanced bit. Referring to FIGS. 3A and 3B of the drawings, FIG. 3A depicts the relative rock volume cut by each blade of a bit according to the present invention and similar to bit 10, wherein it can readily be seen that the rock volumes (expressed as a percent of the total for all the blades) cut by each of the primary blades 18 and 22 (the same reference numerals as in FIG. 1 are employed for clarity) are in substantial balance, and that the rock volumes cut by each of the secondary blades 20 and 24 are in substantial balance. In contrast, another bit of similar design and size, but wherein design balance of relative rock volume to be cut or generated by the various blades was not effected, shows balance of secondary blades 120 and 124 but significant imbalance between primary blades 118 and 122. In head to head drilling tests, the balanced bit drilled at a significantly greater ROP than the unbalanced bit before clogging. Further, the dominant primary blade 122 of the non-balanced bit clogged first on a consistent basis. In additional tests, it was found that proportioning fluid flow volumes according to rock volumes cut by the various blades resulted in still further increases in ROP before balling occurred.

Figure 2A:
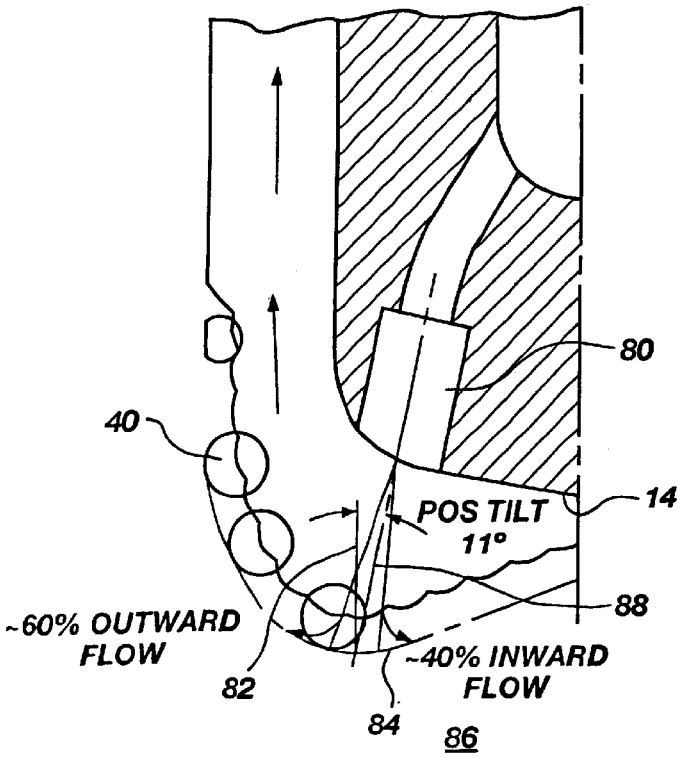
FIG. 2A is a schematic, quarter-sectional side view of the bit of FIG. 1, showing a nozzle oriented with a positive tilt.
Figure 2B:
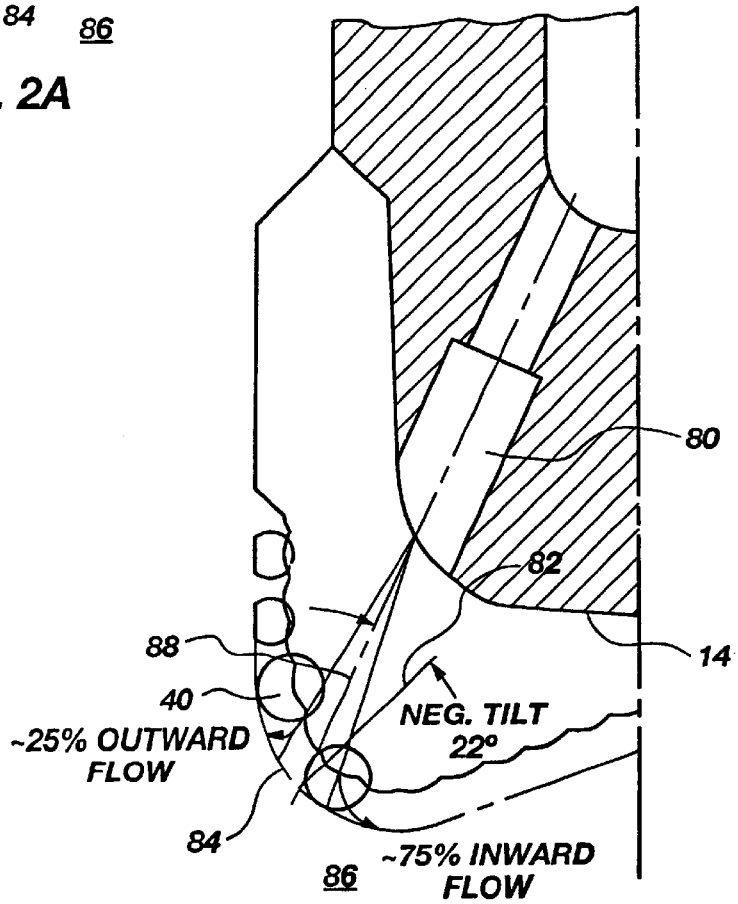
FIG. 2B is a schematic, quarter-sectional side view of another bit, showing a nozzle oriented with a negative tilt.

While sizing and locating nozzles on a bit body may be employed to effect drilling fluid flow proportioning as noted above, FIGS. 2A and 2B of the drawings illustrate that orientation, or tilt, of a nozzle 80 with respect to a line 82 perpendicular to the tangent to the bit profile (followed by the configuration 84 of the well bore bottom 86) at the point of fluid jet impingement on the formation may be desirably used to positively direct fluid flow over the bit face outwardly from the nozzle toward the gage by varying the percentage of flow from a given jet which travels radially outwardly to the gage of the bit and radially inwardly toward the longitudinal axis. FIG. 2A shows that a "positive" jet tilt 88 from a nozzle 80 radially inboard of a line 82 results in a greater outward versus inward flow; in this instance, for example, an 11° positive tilt results in about a 60% outward flow to about a 40% inward flow proportion. In contrast, FIG. 2B shows that a "negative" jet tilt 88 from a nozzle 80 radially outboard of a line 82 undesirably results in a greater inward versus outward flow; in this instance, for example, a 22° negative tilt results in about a 25% outward flow versus about a 75% inward flow. By ensuring a positive tilt of the fluid jet emanating from each nozzle, the large majority of fluid flow volume and energy from each nozzle will be directed outwardly toward the gage, enhancing drilling fluid management and minimizing cross-flow between fluid courses on the bit face to make most efficient use of the fluid energy in cooling the cutters and clearing formation cuttings from the bit.

Figure 4:
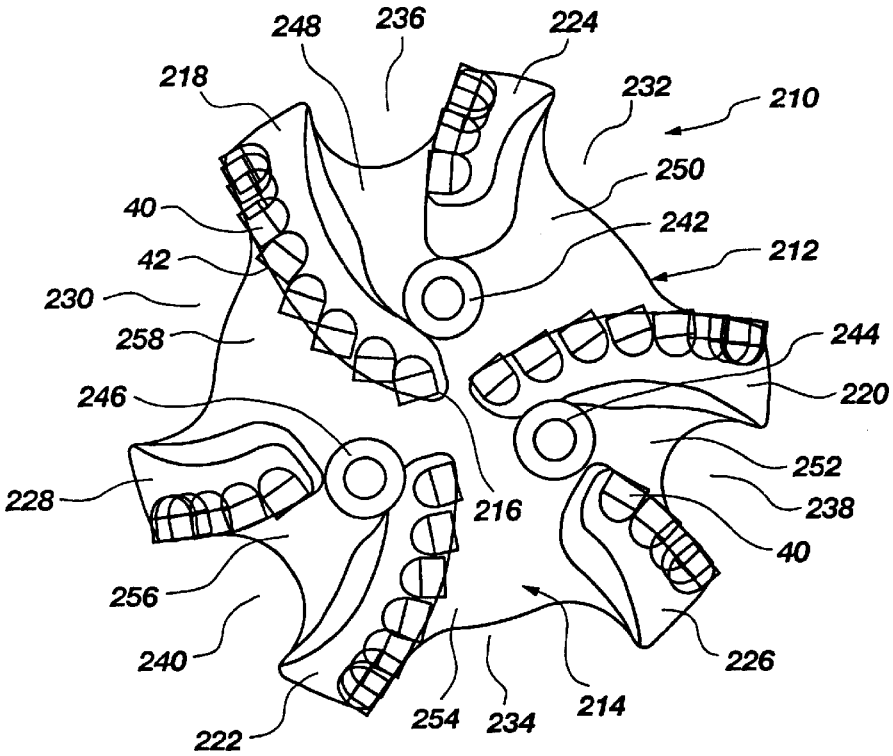
FIG. 4 is a view of a curved-bladed, six-blade bit according to the invention, looking upwardly at the bit face from the formation ahead of the bit.
Figure 4B:
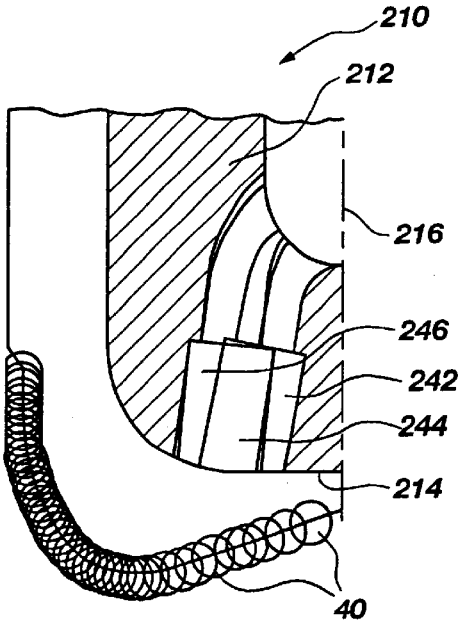
FIG. 4B is a quarter-sectional schematic with the nozzle locations rotated onto a common plane to highlight the locational and orientational differences.
Figure 4A:
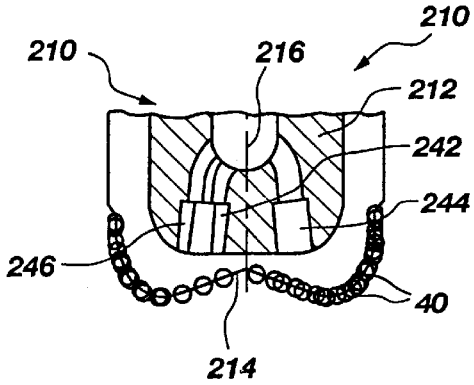
FIG. 4A is a half-sectional schematic view of the bit of FIG. 4 showing nozzle locations and orientations.
Figure 5:
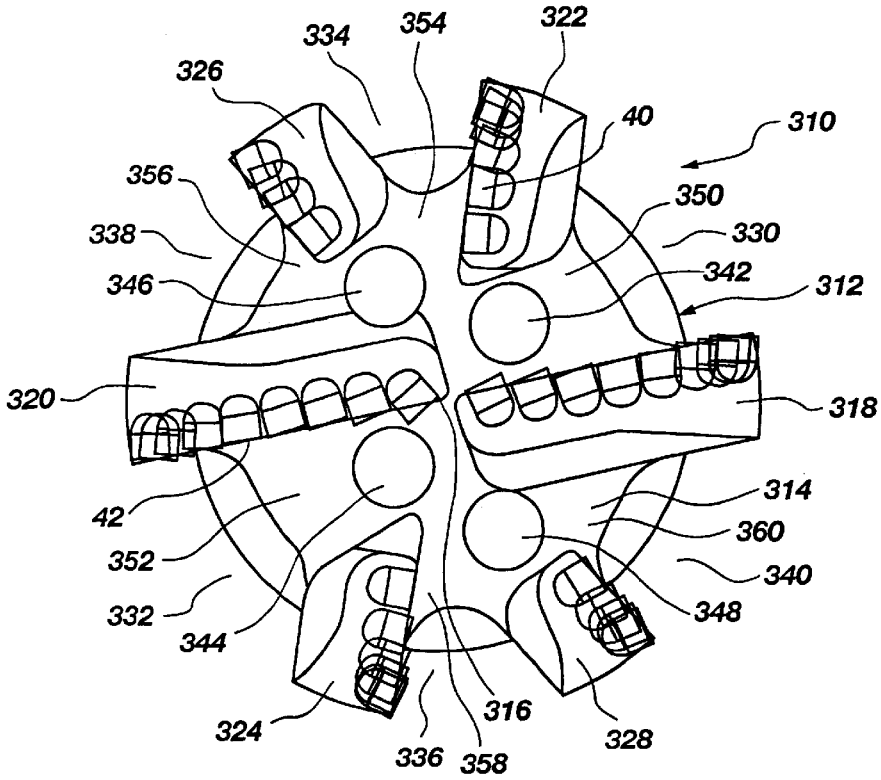
FIG. 5 is a view of a straight-bladed, six-blade bit according to the invention, looking upwardly at the bit face from the formation ahead of the bit.

Similarly, and with specific reference to FIGS. 4, 4A, 4B and 5, 5A and 5B of the drawings, it will be understood and appreciated that bits having fewer nozzles than blades may nonetheless apportion fluid flow between adjacent or communicating primary and secondary blades (or even tertiary blades, as shown in FIG. 5) by nozzle placement in combination with appropriate orientation. As noted previously, while nozzle "tilt" in the context of distribution of fluid flow inwardly or outwardly is one design consideration, nozzle orientation, apart from tilt, relatively toward or away from the entrance or inner end of a particular fluid course may be employed to apportion flow between several fluid courses.

Turning now to FIGS. 4, 4A and 4B of the drawings, a six-bladed drill bit 210 including a bit body 212 having a face 214 extending radially outwardly from longitudinal axis 216 is illustrated. Bit 210 includes three circumferentially spaced, curved primary blades 218, 220 and 222, and three interspersed, curved secondary blades 224, 226 and 228. Primary junk slots 230, 232 and 234 are respectively associated with the primary blades 218, 220 and 222, and secondary junk slots 236, 238 and 240 are respectively associated with secondary blades 224, 226 and 228. Each of the blades bears a plurality or group of superabrasive (PDC) cutters 40 having cutting faces 42. Unlike bit 10, bit 210 carries only half as many nozzles as there are blades, nozzles 242, 244 and 246 each respectively lying between adjacent fluid courses 248 and 250, 252 and 254, and 256 and 258 so that fluid from a single nozzle may feed two fluid courses. There may also be some crossflow across bit body face 214 between other fluid courses, but such is incidental, minimized by the use of positive tilt of nozzles 242, 244 and 246, and comprises only a small portion of the total flow volume. The arrows in FIG. 4 depict the radial orientation of the fluid jets emanating from the nozzles 242, 244 and 246. It should be noted that impingement of the respective fluid jets from nozzles 242, 244 and 246 on radially inner ends of blades 224, 226 and 228 may also be employed as part of the flow apportionment mechanism, although such a technique may eventually cause erosion of blade material over an extended drilling interval. As with bit 10, junk slot transverse entrance areas and fluid flow volumes associated with each of the blades are each proportioned relative to the formation rock volume cut by the cutter group of each blade. Further, the rock volumes to be cut or generated by each primary blade 218, 220 and 222 are substantially mutually balanced, and the rock volumes to be cut or generated by each secondary blade 222, 224 and 226 are substantially mutually balanced. Referencing FIGS. 4A and 4B, the respective positive tilts of nozzles 242, 244 and 246 are shown for a better appreciation of the manner in which such technique is employed to direct drilling fluid flow outwardly toward the gage in each fluid course. In bit 210, all nozzle aperture sizes are equal.

Figure 5B:
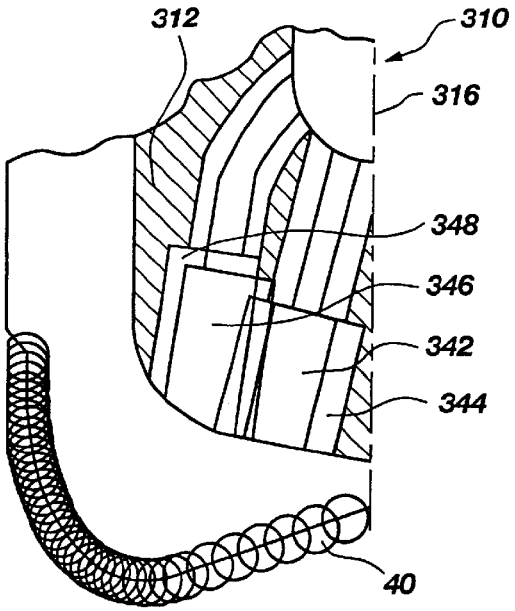
FIG. 5B is a quarter-sectional schematic with the nozzle locations rotated onto a common plane to highlight the locational and orientational differences.
Figure 5A:
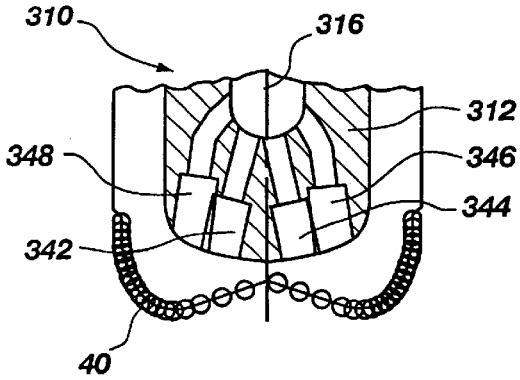
FIG. 5A is a half-sectional schematic view of the bit of FIG. 5 showing nozzle locations and orientations.

Turning to FIGS. 5, 5A and 5B of the drawings, a six-bladed drill bit 310 including a bit body 312 having a face 314 extending radially outwardly from longitudinal axis 316 is illustrated. Bit 310 includes two circumferentially spaced, straight primary blades 318 and 320, two secondary blades 322 and 324, and two tertiary blades 326 and 328. The terms "primary," "secondary" and "tertiary" are employed with regard to the relative volumes of rock cut by the cutter groups of the various blades. Primary junk slots 330 and 332 are respectively associated with the primary blades 318 and 320, secondary junk slots 334 and 336 with secondary blades 322 and 324, and tertiary junk slots 338 and 340 with tertiary blades 326 and 328. Each of the blades bears a plurality or group of superabrasive (PDC) cutters 40 having cutting faces 42. Bit 310 carries four nozzles 342, 344, 346 and 348. Nozzles 342 and 344 feed drilling fluid to fluid courses 350 and 352 associated with the primary blades 318 and 320, while nozzles 346 and 348 each contribute flow to both a secondary fluid course and a tertiary fluid course, nozzle 346 feeding fluid courses 354 and 356 and nozzle 348 feeding fluid courses 358 and 360. Again, as with bit 210, drilling fluid from a single nozzle may feed two fluid courses. As noted before, there may also be some crossflow across bit body face 314 between other fluid courses, but such is incidental, minimized by the positive tilts of the nozzle flows, and comprises only a small portion of the total flow volume. The arrows in FIG. 5 depict the radial orientation of the fluid jets emanating from the nozzles 342 through 348. As with bits 10 and 210, fluid flow volumes associated with each of the blades are each proportioned relative to the formation rock volume cut by the cutter group of each blade. However, unlike bits 10 and 210, the junk slot entrance areas of the primary, secondary and tertiary junk slots are not proportioned in strict accordance with the invention. Primary junk slots 330 and 332 exhibit such proportioning. Secondary junk slots 334, 336 and tertiary junk slots 338, 340 are not individually sized with respect to relative rock volumes cut by their associated blades although the total entrance area of each pair of adjacent secondary and tertiary junk slots is generally proportioned to the rock volume cut by the blade pair associated with those junk slots. Further, the rock volumes to be cut or generated by each blade of a type or category, primary, secondary or tertiary, are substantially mutually balanced. Referencing FIGS. 5A and 5B, the respective positive tilts of nozzles 342 through 348 are shown for a better appreciation of the manner in which such technique is employed to direct drilling fluid flow outwardly to the gage.

In the practice of flow apportionment or drilling fluid management according to the present invention, it may be stated as a general guideline that nozzles should be tilted so that the flow emanating therefrom is directed outwardly toward the junk slots. The amount or degree of tilt may be limited in some instances by bit geometry and the proximity of other nozzles, but in general it has been found that a positive tilt of between about 10° and about 25° is usually possible, and should be effected so as to direct the predominant portion of drilling fluid flow outwardly. Further, it may be generally stated, as a rule of thumb for bits having a profile defined by an indented center cone portion and a nose radially outboard thereof, that a positive fluid flow (i.e., toward the gage of the bit) may be effected by placing and orienting a nozzle to cause a fluid jet from the nozzle to impinge on the formation at a radial location no greater than that defined by the farthest leading longitudinal extent of the nose.

While the present invention has been described with reference to certain illustrated embodiments, those of ordinary skill in the art will understand and appreciate that it is not so limited. Many additions, deletions and modifications to the illustrated embodiments, as well as combinations of features from different embodiments, may be effected without departing from the scope of the invention as set forth in the claims. Further, one or more of the inventive features of the present invention may be employed in a given bit to achieve perceptible benefits, although all such features may not be employed.

What is claimed is:

1. A rotary drag bit for drilling a subterranean formation, comprising:

a bit body having a longitudinal axis and a face thereon extending radially outward from the longitudinal axis;

a plurality of blades extending above and generally radially over the face and outwardly of the bit body, the blades separating and defining the plurality of radially extending fluid courses leading to a plurality of junk slots extending longitudinally away from the bit body face;

a plurality of cutters mounted to each of the plurality of blades, the plurality of cutters of at least one blade differing in at least one of number, size and exposure from a plurality of cutters mounted to at least one other blade such that a different formation cuttings volume is to be generated from engagement of the subterranean formation by the at least one blade cutters and the at least another blade cutters; and a plurality of nozzles for discharging drilling fluid from the bit body face into an area between the bit body face and the formation, the plurality of nozzles being located and oriented to apportion a discharge of drilling fluid between a fluid course positioned to receive formation cuttings generated by that at least one blade cutters and a fluid course positioned to receive formation cuttings generated by the at least another blade cutters in general proportion to the relative volumes of formation cuttings generated by each of the at least one blade cutters and the at least another blade cutters, the plurality of nozzles being further located and oriented to provide drilling fluid flow to each of the plurality of fluid courses so that a predominant flow direction in each of the fluid courses of the plurality is outwardly away from the longitudinal axis of the bit body and there is minimal cross-flow of fluid from a radially inner end of one fluid course into a radially inner end of any other fluid course.

2. The rotary drag bit of claim 1, wherein each of the plurality of nozzles is oriented at a positive tilt.

3. The rotary drag bit of claim 2, wherein each of the plurality of nozzles is oriented at a positive tilt angle of no less than about 10°.

4. The rotary drag bit of claim 3, wherein each of the plurality of nozzles is oriented at a positive tilt angle of no more than about 25°.

5. The rotary drag bit of claim 1, wherein the bit includes a profile comprising a cone proximate the longitudinal axis and a nose radially outward of the cone, and wherein each of the nozzles of the plurality is oriented so as to cause a jet of drilling fluid emanating therefrom to impact the formation substantially radially inwardly of a farthest leading longitudinal extent of the nose.

6. The rotary drag bit of claim 1, wherein the plurality of blades comprises at least two categories, primary and secondary, and wherein each primary blade will generate a substantially greater volume of formation cuttings than each secondary blade, and the nozzles are further located and oriented to cause drilling fluid to flow through a fluid course associated with each of the plurality of blades to a corresponding one of the junk slots in general proportion to the relative formation cuttings volumes generated by the plurality of blades.

7. The rotary drag bit of claim 6, wherein the cutters on the primary blades are disposed, through variations in at least one of cutter number, size and exposure, to generate substantially similar formation cuttings volume from each of the primary blades.

8. The rotary drag bit of claim 7, wherein the cutters on the secondary blades are disposed, through variations in at least one of cutter number, size and exposure, to generate substantially similar formation cuttings volume from each of the secondary blades.

9. The rotary drag bit of claim 8, wherein each of said plurality of junk slots has a cross-sectional entrance area at a periphery of the bit face, measured transverse to the longitudinal axis, and the transverse cross-sectional entrance areas of junk slots associated with each of the primary blades are substantially the same, and the transverse cross-sectional entrance areas of junk slots associated with each of the secondary blades are substantially the same.

10. The rotary drag bit of claim 1, wherein at least one junk slot is positioned to receive formation cuttings from the at least one blade cutters and at least another junk slot is positioned to receive formation cuttings from the at least another blade cutters, and wherein cross-sectional areas transverse to the longitudinal axis of the bit body at an entrance adjacent the bit body face of each of the at least one junk slot and the at least another junk slot are generally sized in proportion to the formation cuttings volume to be respectively generated by each of the at least one blade cutters and the at least another blade cutters.

11. The rotary drag bit of claim 1, wherein one nozzle of the plurality of nozzles is configured to apportion a discharge of drilling fluid therefrom between the fluid course associated with the at least one blade cutters and the fluid course associated with the at least another blade cutters in general proportion to the relative volumes of formation cuttings generated by each of the at least one blade cutters and the at least another blade cutters.

12. A rotary drag bit for drilling a subterranean formation, comprising:

a bit body having a longitudinal axis and a face thereon extending radially outward from the longitudinal axis;

a plurality of blades extending above and generally radially over the face and outwardly of the bit body, the blades separating and defining the plurality of radially extending fluid courses leading to a plurality of junk slots extending longitudinally away from the bit body face;

a plurality of cutters mounted to each of the plurality of blades, the plurality of cutters of at least one blade differing in at least one of number, size and exposure from a plurality of cutters mounted to at least one other blade such that a different formation cuttings volume is to be generated from engagement of the subterranean formation by the at least one blade cutters and the at least another blade cutters, at least one of said plurality of junk slots being positioned to receive formation cuttings from the at least one blade cutters and at least another junk slot being positioned to receive formation cuttings from the at least another blade cutters, wherein cross-sectional areas transverse to the longitudinal axis of the bit body at an entrance adjacent the bit body face of each of the at least one junk slot and the at least another junk slot are generally sized in proportion to the formation cuttings volume to be respectively generated by each of the at least one blade cutters and the at least another blade cutters; and a plurality of nozzles for discharging drilling fluid from the bit body face into an area between the bit body face and the formation, the plurality of nozzles being located and oriented to provide drilling fluid flow to each of the plurality of fluid courses so that a predominant flow direction in each of the fluid courses of the plurality is outwardly away from the longitudinal axis of the bit body and there is minimal cross-flow of fluid from a radially inner end of one fluid course into a radially inner end of any other fluid course.

13. The rotary drag bit of claim 12, wherein each of the plurality of nozzles is oriented at a positive tilt.

14. The rotary drag bit of claim 13, wherein each of the plurality of nozzles is oriented at a positive tilt angle of no less than about 10°.

15. The rotary drag bit of claim 14, wherein each of the plurality of nozzles is oriented at a positive tilt angle of no more than about 25°.

16. The rotary drag bit of claim 12, wherein the bit includes a profile comprising a cone proximate the longitudinal axis and a nose radially outward of the cone, and wherein each of the nozzles of the plurality is oriented so as to cause a jet of drilling fluid emanating therefrom to impact the formation substantially radially inwardly of a farthest leading longitudinal extent of the nose.

17. The rotary drag bit of claim 12, wherein the plurality of blades comprises at least two categories of blades, primary and secondary, and wherein each primary blade will generate substantially more formation cuttings volume than each secondary blade, and junk slots respectively associated with the primary blades and the secondary blades are proportionally sized in transverse cross-sectional entrance area in general accordance with the relative volumes of formation cuttings to be received.

18. The rotary drag bit of claim 17, wherein the cutters on the primary blades are disposed, through variations in at least one of cutter number, size and exposure, to generate substantially similar formation cuttings volume from each of the primary blades.

19. The rotary drag bit of claim 18, wherein the cutters on the secondary blades are disposed, through variations in at least one of cutter number, size and exposure, to generate substantially similar formation cuttings volume from each of the secondary blades.

20. The rotary drag bit of claim 19, wherein the transverse cross-sectional entrance area of junk slots associated with each of the primary blades is substantially the same, and the transverse cross-sectional entrance area of junk slots associated with each of the secondary blades is substantially the same.

21. The rotary drag bit of claim 12, wherein there are fewer nozzles than blades, and wherein at least one nozzle of the plurality of nozzles, through variation in at least one of size, shape, orientation and location, provides substantially all of the drilling fluid flow through two radially extending fluid courses of said plurality of radially extending fluid courses.

* * * * *

UNITED STATES PATENT AND TRADEMARK OFFICE

CERTIFICATE OF CORRECTION

PATENT NO. : 6,250,408 B1 
DATED : June 26, 2001
INVENTOR(S) : William R. Trujillo and Craig H. Cooley It is certified that error appears in the above-identified patent and that said Letters Patent is hereby corrected as shown below:

Drawings,
FIG. 1, add arrows as indicated in nozzles 62, 64, and 66 (shown below)

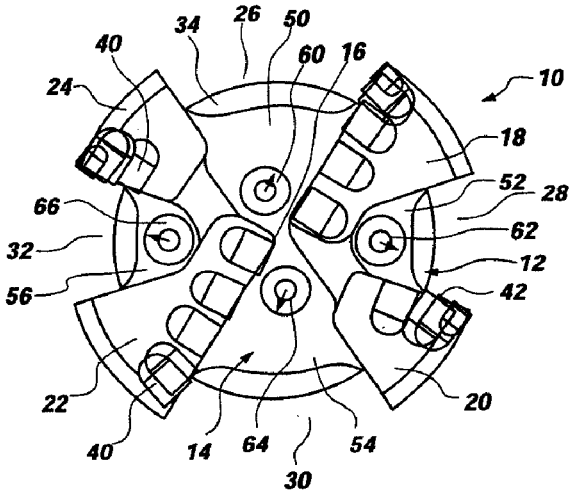

Fig. 1

FIG. 4, add arrows as indicated in nozzles 242, 244, and 246 (shown below)

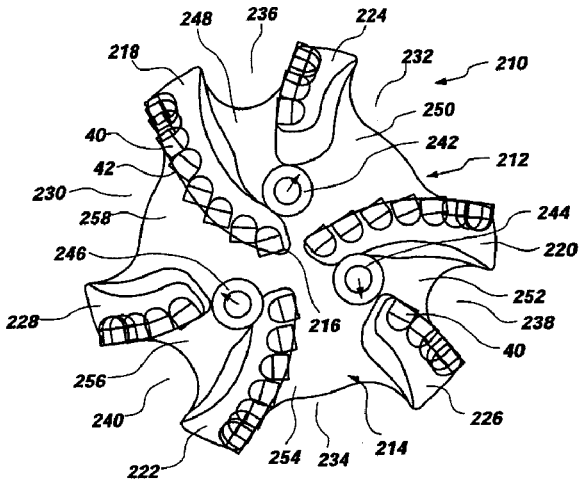

Fig. 4

UNITED STATES PATENT AND TRADEMARK OFFICE

CERTIFICATE OF CORRECTION

PATENT NO. : 6,250,408 B1 
DATED : June 26, 2001
INVENTOR(S) : William R. Trujillo and Craig H. Cooley It is certified that error appears in the above-identified patent and that said Letters Patent is hereby corrected as shown below:

Drawings (cont'd),
FIG. 5, add arrows as indicated in nozzles 342, 244, 346, and 348 (shown below)

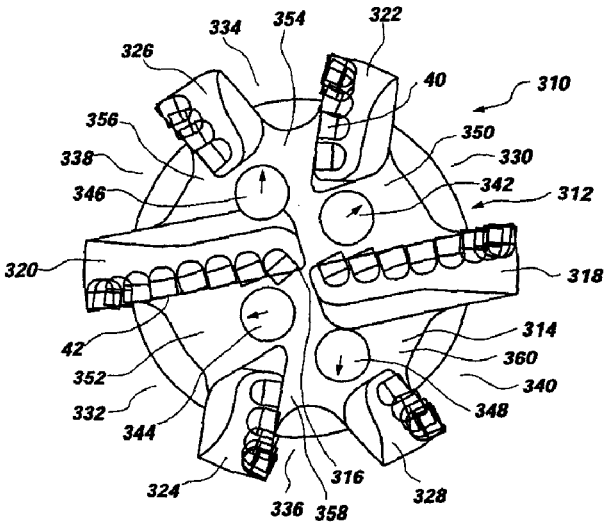

*Fig. 5*

Column 2,
Line 55, insert a comma after "Therefore" and delete the comma after "orientation"
Line 56, delete the comma after "aperture"

Column 3,
Line 5, insert a comma after "Again"
Line 14, delete the comma after "slots"

Column 4,
Line 27, delete the comma after "32"
Line 58, delete the comma after "sized"
Line 60, delete the comma after "16"

Column 5,
Line 1, change "30" to -- 32 --
Line 54, delete the comma after "orientation" and delete the comma after "tilt"

UNITED STATES PATENT AND TRADEMARK OFFICE

CERTIFICATE OF CORRECTION

PATENT NO. : 6,250,408 B1
DATED : June 26, 2001
INVENTOR(S) : William R. Trujillo and Craig H. Cooley It is certified that error appears in the above-identified patent and that said Letters Patent is hereby corrected as shown below:

Column 7,
Line 34, insert a comma after "blades"

Column 8,
Line 14, at the beginning of the line, before "blades" insert -- plurality of -- and after "defining" change "the" to -- a --
Line 14, after "of" and before "radially" insert -- generally --
Line 25, change "another" to -- one other --
Line 28, after "the" and before "formation" insert -- subterranean --
Line 31, before "at" change "that" to -- the --
Line 33, change "another" to -- one other --
Line 36, before "blade" change "another" to -- one other --
Line 40, after "the" and before "fluid" insert -- generally radially extending --
Line 53, after "the" and before "bit" insert -- rotary drag --
Line 57, after "the" and before "formation" insert -- subterranean --
Line 64, after "the" and before "nozzles" insert -- plurality of --
Line 67, after "the" and before "junk" insert -- plurality of --

Column 9,
Line 3, before "cutters" delete "the" and at the end of the line, after "on" insert -- said each of --
Line 6, after "from" and before "each" insert -- said --
Line 8, at the end of the line, after "on" insert -- said each of --
Line 11, after "from" and before "each" insert -- said --
Line 17, after "with" and before "each" insert -- said --
Line 19, after "with" and before "each" insert -- said --
Line 25, before "blade" change "another" to -- one other --
Line 31, change "another" to -- one other --
Line 35, after "blade" and before "cutters" insert -- of the plurality of --
Line 36, change "another" to -- one other --
Line 39, change "another" to -- one other --
Line 46, at the beginning of the line, before "blades" insert -- plurality of -- and after "defining" change "the" to -- a --
Line 57, before "blade" change "another" to -- one other --
Line 61, after "least" and change "another" to -- one other --

UNITED STATES PATENT AND TRADEMARK OFFICE

CERTIFICATE OF CORRECTION

PATENT NO. : 6,250,408 B1 
DATED : June 26, 2001
INVENTOR(S) : William R. Trujillo and Craig H. Cooley It is certified that error appears in the above-identified patent and that said Letters Patent is hereby corrected as shown below:

Column 10,
Line 5, change "another" to -- one other --
Line 8, after "the" and before "formation" insert -- subterranean --
Line 24, after "the" and before "bit" insert -- rotary drag --
Line 29, after "the" and before "formation" insert -- subterranean --
Line 36, after "with" and before "the" insert -- said each of -- and after "and" insert -- said each of --
Line 40, before "cutters" delete "the" and at the end of the line, after "on" insert -- said each of --
Line 43, after "from" and before "each" insert -- said --
Line 45, after "on" insert -- said each of --
Line 48, after "from" and before "each" insert -- said --
Line 52, before "each" insert -- said --
Line 54, after "with" and before "each" insert -- said --

Signed and Sealed this

Twenty-fifth Day of January, 2005

JON W. DUDAS
*Director of the United States Patent and Trademark Office*